US005290083A

United States Patent [19]

Rissley

[11] Patent Number: 5,290,083

[45] Date of Patent: Mar. 1, 1994

[54] DOUBLE BOTTLE CARRIER

[75] Inventor: Stewart R. Rissley, Bangor, Mich.

[73] Assignee: Do-It Corporation, South Haven, Mich.

[21] Appl. No.: 970,711

[22] Filed: Nov. 3, 1992

[51] Int. Cl.[5] ..... B65D 71/00

[52] U.S. Cl. ..... 294/87.2; 206/150; 294/159

[58] Field of Search ..... 294/27.1, 31.2, 87.2–87.28, 294/143, 149, 151, 152, 159–167; 206/139, 141, 145, 147, 150, 151, 153, 162, 163, 199, 200, 427, 428; 215/100 A

[56] References Cited

U.S. PATENT DOCUMENTS

| | | | |
|---|---|---|---|
| 2,320,440 | 6/1943 | Kruea et al. | 294/87.26 |
| 2,330,699 | 9/1943 | Flamm | 294/87.26 |
| 2,397,716 | 4/1946 | Wendler | 294/87.2 |
| 2,513,762 | 7/1950 | Tyson | 294/159 |
| 3,016,259 | 1/1962 | Lawrence | 294/87.2 |
| 3,073,644 | 1/1963 | Baker et al. | 294/87.2 |
| 3,232,422 | 2/1966 | Whyte | 294/87.2 X |
| 3,385,626 | 5/1968 | Wozniak | 294/87.2 |
| 3,524,671 | 8/1970 | Akeireb | 294/87.2 |
| 3,608,949 | 9/1971 | Owen | 294/87.2 |
| 3,727,754 | 4/1973 | Cunningham | 294/87.2 X |
| 3,815,947 | 6/1974 | Olsen | 294/87.2 |
| 4,093,295 | 6/1978 | Erickson | 294/87.2 |
| 4,196,807 | 4/1980 | Brom | 294/87.2 X |
| 4,390,095 | 6/1983 | Cunningham | 206/150 |
| 4,544,194 | 10/1985 | Allen | 294/87.2 |
| 4,582,215 | 4/1986 | Barrash | 294/31.2 X |
| 4,850,479 | 7/1989 | Bird | 294/87.2 X |
| 5,060,999 | 10/1991 | Marvin | 294/87.2 |

*Primary Examiner*—Johnny D. Cherry
*Attorney, Agent, or Firm*—Flynn, Thiel, Boutell & Tanis

[57] ABSTRACT

A one-piece container carrier formed from a flat, generally rectangular, sheet of resilient material and having at least two sets of two sockets aligned in a row and formed in the body member for receiving and gripping beneath an enlarged rim on a reduced diameter neck portion on at least a pair of containers. A pair of handles are integrally joined at opposite ends thereof at four spaced corner portions to the body member and initially lie within a plane of the body member and along opposite lateral sides of the sockets. When the body member is deformed to bring the two sockets of each set into axial alignment with one another and the reduced diameter neck portion on each container is received in and extends through the axially aligned sockets of each set, the elasticity of the material forming the handles causes the handles to automatically adopt a shape between the respective opposite ends thereof that is substantially resiliently displaced out of the plane of a remaining portion of the body member while remaining on the aforesaid opposite lateral sides of the sockets.

8 Claims, 2 Drawing Sheets

DOUBLE BOTTLE CARRIER

FIELD OF THE INVENTION

This invention relates to a one-piece container carrier and, more particularly, to a container carrier adapted to carry a pair of containers having a reduced diameter neck portion thereon, such as a pair of wine bottles.

BACKGROUND OF THE INVENTION

In the marketing of beverages, such as wine, wine is placed into bottles that have a reduced diameter neck portion. These bottles of wine are usually sold one at a time or by the case. The provision for carrying at least two wine bottles would enable a different marketing strategy for wine and would make it more convenient to the customer to carry at least two bottles of wine with a single carrier device.

Accordingly, it is an object of this invention to provide a one-piece container carrier adapted for use in carrying at least a pair of containers having a reduced diameter neck portion thereon.

It is a further object of this invention to provide a one-piece container carrier, as aforesaid, which is specifically adapted for use in carrying at least a pair of wine bottles.

It is a further object of this invention to provide a one-piece container carrier, as aforesaid, which is economically made from a flat, generally rectangular, sheet of resilient material with little or no waste being generated by the formation of the container carrier.

It is a further object of this invention to provide a one-piece container carrier, as aforesaid, wherein the carrier is adapted to be fitted over the reduced diameter neck portion of each container and oriented beneath an enlarged rim on the neck so as to be securely held in association with the container.

SUMMARY OF THE INVENTION

The objects and purposes of the invention have been met by providing a one-piece container carrier formed from a flat, generally rectangular, sheet of resilient material and having at least two sets of two socket means aligned in a row and formed in the body member for receiving and gripping beneath an enlarged rim on a reduced diameter neck portion on at least a pair of containers. A pair of integrally generally U-shaped handles are formed at four spaced corner portions to the body member at opposite ends thereof and initially line within a plane of the body member within the confines thereof and along opposite lateral sides of the socket means. The handle means are so shaped at the ends thereof which join the body member as to be substantially resiliently displaceable transversely to the plane of the body member.

BRIEF DESCRIPTION OF THE DRAWINGS

Other objects and purposes of this invention will be apparent to persons of ordinary skill in the art upon reading the following specification with reference to the accompanying drawings, in which.

DETAILED DESCRIPTION

Figure 1:
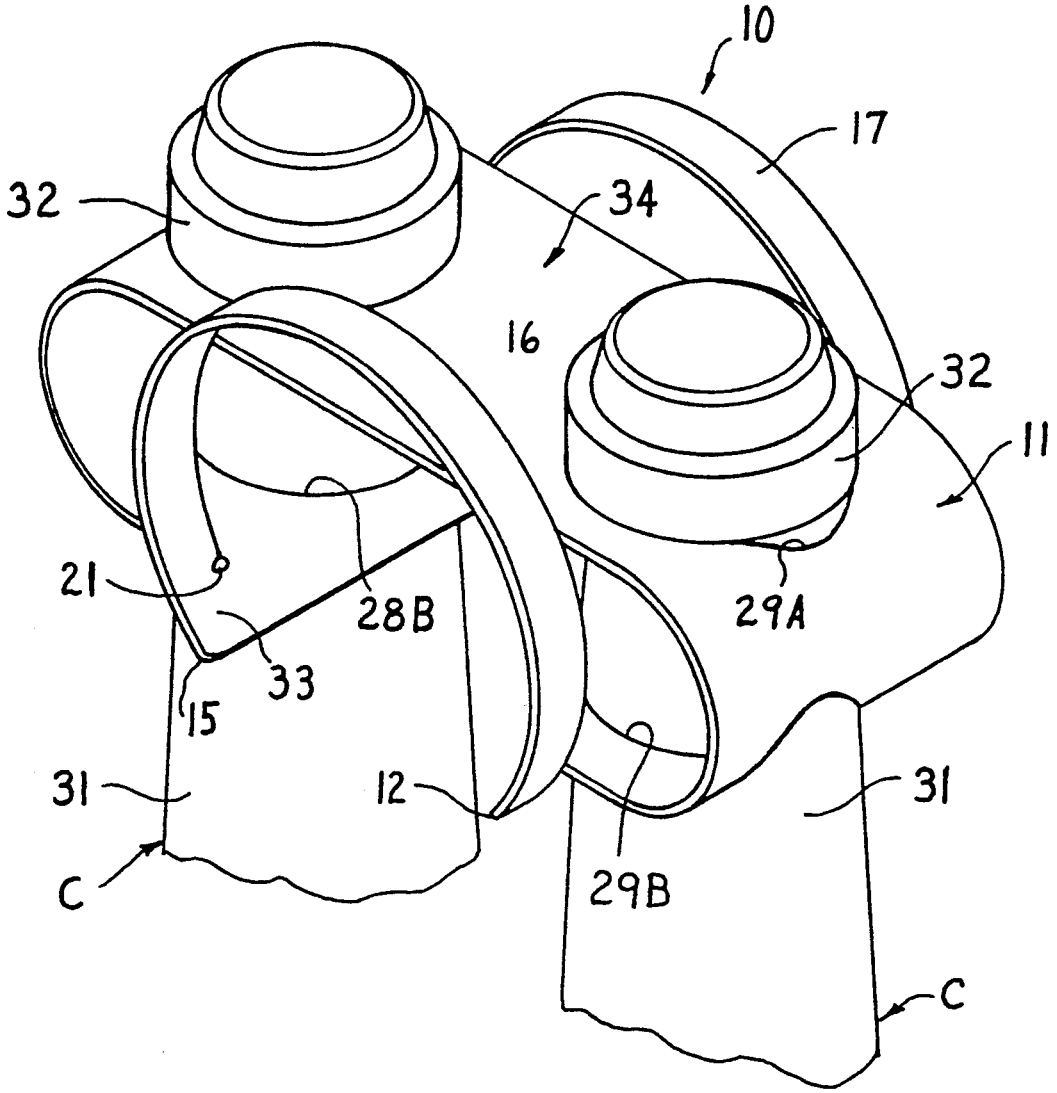
FIG. 1 is an isometric view of a one-piece container carrier embodying the invention.
Figure 2:
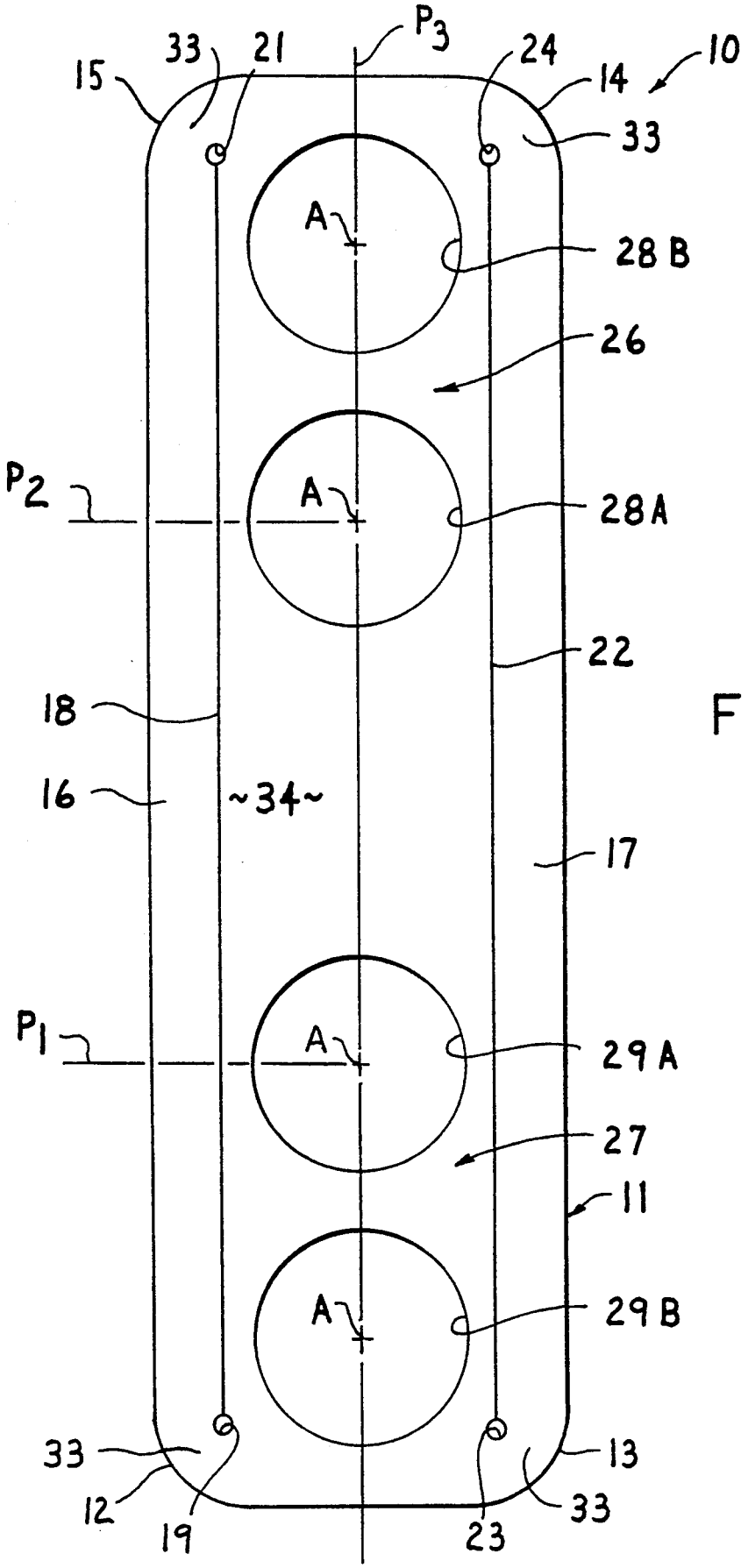
FIG. 2 is a top plan view of the carrier embodying the invention.

FIG. 1 illustrates a one-piece container carrier 10 embodying the invention. The container carrier 10 includes an elongated body member 11 that is of a generally rectangular shape having four spaced corners 12, 13, 14 and 15. A pair of strap-like handles 16 and 17 are formed along lateral edges of the rectangular shape body member as illustrated in FIG. 2. The strap 16 is, for example, created when a die cut slot 18 is provided through the material of the body member 11 extending parallel to a lateral edge of the body member 11 from a region 19 adjacent the corner 12 to a region 21 adjacent the opposite corner 15. Similarly, the strap-like handle 17 is formed by a die cut slot 22 extending through the material of the body member 11, the cut slot 22 extending parallel to the cut slot 18 between a region 23 adjacent the corner 13 and a region 24 adjacent the corner 14. In this particular embodiment, the regions 19, 21, 23 and 24 are circular in shape and are of a small diameter.

Intermediate the die cut slots 18 and 22 there are provided two sets 26 and 27 of sockets or holes through the material of the base member 11. The set 26 includes two such holes 28A and 28B whereas the set 27 includes two holes 29A and 29B. Each set of holes 28A, 28B and 29A, 29B is grouped together and spaced from the other set by a distance that is greater than the spacing between the mutually adjacent holes in each set 26 and 27. The spacing between each set 26 and 27 is adjustable to accommodate the type of container that is to be carried by the inventive one-piece container carrier 10. Further, the diameters of each of the holes 28A, 28B, 29A, 29B are of a size to accommodate the reduced diameter neck portion of a container, especially that portion which is oriented beneath an enlargement adjacent the top of the reduced diameter neck portion of the container.

When used in association with a pair of containers having a reduced diameter neck portion 31 as illustrated in FIG. 1, the container should also have an enlargement 32 at the upper end of the reduced diameter neck portion 31. The enlargement can be either an integrally formed rim at the upper end of the neck 31 or it can be a cap fastened over the upper end of the upper open end of the container C. Further, the material of the body member 11 is to have sufficient elasticity to allow the holes 28A, 28B, 29A, 29B to fit over the enlargement 32. Further, the material 11 is to have sufficient elasticity and memory to return to the original diameter of the hole shown in FIG. 2 so that the inwardly facing surface of each of the holes will be oriented inside of an outermost extremity of the enlargement 32.

The body member 11 of the container carrier 10 can be made in any desired manner and from any suitable material. It is preferably die cut from a plastic sheet such as a 0.020 inch thick sheet of a resilient, elastic, deformable plastic material such as a semi-crystalline polymer, one example of which is polyethylene.

Further, the carrier could be widened to include four sets of two holes oriented along side of the sets 27 and 28 and between the pair of handles 16 and 17. However, in this particular embodiment, the container carrier is adapted to carry two such containers C. The body member is formed so that the two holes 28A and 28B as well as the two holes 29A and 29B of each set 26 and 27, respectively, become axially aligned with one another, that is, one above the other as illustrated in FIG. 1. The reduced diameter neck of each container is inserted through the now aligned holes in each set. Further, the holes both become oriented beneath the enlargement 32 and, due to the elasticity of the material of the body member, quickly conform to the outside diameter of the neck portion 31 of each container C. The connecting portions 33 generally between each region 19, 21, 23 and 24 and the associated corner 12, 15, 13 and 14, respectively, are oriented beneath a midlength portion 34 of the body member 11 and between a pair of parallel planes $P_1$ and $P_2$, each plane $P_1$, $P_2$ containing a set of aligned axes A of the two holes 28A, 28B and 29A, 29B in each set 26 and 27, respectively. The planes $P_1$ and $P_2$ are furthermore perpendicular to a plane containing the sets of aligned axes, namely, plane $P_3$. It will also be noted that when the body member 11 is formed into the shape illustrated in FIG. 1, the aligned axes A of each set of holes 26 and 27 become generally oriented perpendicular to a plane containing the midportion 34. The plane $P_3$ extends through the vertically aligned axes which extend generally perpendicular to the plane of the midportion 34 and the corners 12, 13 and 14, 15 are oriented intermediate the pair of parallel planes $P_1$ and $P_2$.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A one-piece container carrier, comprising a flat, generally rectangular, sheet of resilient, elastically deformable, material, means defining at least two sets of two sockets in said body member and aligned in a single row for receiving therethrough and gripping therebeneath an enlargement on a reduced diameter neck portion on each of at least a pair of containers, and means defining at least one elongated integrally joined at opposite ends thereof to said body member at two spaced corner portions of said body member and initially lying within a plane of said body member and extending along one lateral side of said sockets parallel to said single row of said at least two sets of two sockets, said body member being formable to bring said two sockets of each set into axial alignment with one another, the reduced diameter neck portion on each container being adapted to be received in and extend through said axially aligned sockets of each set, the elasticity of the material forming said handle causing said handle to automatically adopt a shape between the respective opposite ends thereof that is substantially resiliently displaced out of the plane of a remaining portion of said body member while remaining on said one lateral side of said sockets.

2. The one-piece container carrier according to claim 1, wherein said handle comprises a strap-like element and connecting portions between the respective ends of said strap-like element and said two corner portions of said body member.

3. The one-piece container carrier according to claim 2, wherein when said body member is deformed to bring said two sockets of each set into axial alignment with one another, said connecting portions become oriented beneath a midlength portion of said body member located between said two sets of two sockets and between a pair of parallel planes each containing a single set of aligned axes of said two sockets and extending perpendicular to a plane containing said at least two sets of aligned axes.

4. The one-piece container carrier according to claim 1, wherein said material is a thin sheet of plastic.

5. The one-piece container carrier according to claim 4, wherein said plastic is a semicrystalline polymer.

6. The one-piece container carrier according to claim 5, wherein said polymer is polyethylene.

7. The one-piece container carrier according to claim 1, wherein said sockets and said handles are die cut from a 0.020 inch thick plastic sheet.

8. The one-piece container carrier according to claim 1, wherein said means defining at least one handle includes means defining a further handle extending parallel to said one handle and located on a lateral side of said sockets remote from said one handle.

* * * * *

UNITED STATES PATENT AND TRADEMARK OFFICE

CERTIFICATE OF CORRECTION

PATENT NO. : 5 290 083

DATED : March 1, 1994

INVENTOR(S) : Stewart R. RISSLEY

It is certified that error appears in the above-identified patent and that said Letters Patent is hereby corrected as shown below:

Column 3, line 40; after "elongated" insert ---handle---.

Signed and Sealed this

Thirtieth Day of August, 1994

*Attest:*

Bruce Lehman

BRUCE LEHMAN

*Attesting Officer*

*Commissioner of Patents and Trademarks*